US005310631A

United States Patent [19]

Nakamura et al.

[11] Patent Number: 5,310,631

[45] Date of Patent: May 10, 1994

[54] METHOD OF PROCESSING A SILVER HALIDE PHOTOSENSITIVE MATERIAL CONTAINING A SILVER HALIDE SENSITIZED WITH A SELENIUM SENSITIZER USING A BLACK-AND-WHITE DEVELOPER CONTAINING A CHELATE COMPLEX SALT OF A TRANSITION METAL

[75] Inventors: Takashi Nakamura; Yasuhisa Ogawa; Masato Hirano, all of Kanagawa, Japan

[73] Assignee: Fuji Photo Film Co., Ltd., Kanagawa, Japan

[21] Appl. No.: 47,289

[22] Filed: Apr. 19, 1993

[30] Foreign Application Priority Data

Apr. 20, 1992 [JP] Japan ..... 4-125407

[51] Int. Cl.[5] ..... G03C 5/18; G03C 5/26; G03C 1/06; G03C 5/00

[52] U.S. Cl. ..... 430/447; 430/479; 430/603; 430/30; 430/399; 430/435; 430/600

[58] Field of Search ..... 430/434, 447, 479, 30, 430/399, 603, 403, 413, 435

[56] References Cited

U.S. PATENT DOCUMENTS

| | | | |
|---|---|---|---|
| 2,073,621 | 3/1937 | Blaney | 430/399 |
| 3,297,447 | 1/1967 | McVeigh | 430/600 |
| 3,420,670 | 1/1969 | Milton | 430/603 |
| 3,938,998 | 2/1976 | Fisch et al. | 96/66.3 |
| 3,942,985 | 3/1976 | Newman et al. | 96/66.3 |
| 3,945,828 | 3/1976 | Iwano | 430/399 |
| 3,982,945 | 9/1976 | Willems | 430/479 |
| 4,115,129 | 9/1978 | Bigelow | 430/601 |
| 4,284,717 | 8/1981 | Toya et al. | 430/603 |
| 4,606,827 | 8/1986 | Ernstson et al. | 430/399 |
| 4,680,123 | 7/1987 | Wernicke et al. | 430/399 |
| 4,810,626 | 3/1989 | Burgmaier et al. | 430/603 |
| 5,070,004 | 12/1991 | Fujita et al. . | |
| 5,118,595 | 6/1992 | Ishikawa | 430/434 |
| 5,215,880 | 6/1993 | Kojima et al. | 430/603 |

FOREIGN PATENT DOCUMENTS

| | | |
|---|---|---|
| 0532003 | 9/1992 | European Pat. Off. . |
| 4-41899 | 12/1979 | Japan . |
| 4-243253 | 8/1992 | Japan . |
| 4-250449 | 9/1992 | Japan . |

OTHER PUBLICATIONS

"Metalorganic Silver Halide Developers", Research Disclosure 12142, May 1974, pp. 41–42.

Database WPIL Section Ch, Week 8423, Derwent Publications Ltd., London GB; AN 84-145630 & SU-A-1 043 137 (As Ukr Gen Inorg Chem) Sep. 23, 1983.

Nippon Shashin Zasshi, 29, 31 (1966).

Nippon Shashin Zasshi, 45 (1), 33 (1982).

JP04-250449, English Abstract of Japanese Patent Document, from ORBIT Search.

*Primary Examiner*—Charles L. Bowers, Jr.

*Assistant Examiner*—J. Pasterczyk

*Attorney, Agent, or Firm*—Sughrue, Mion, Zinn, Macpeak & Seas

[57] ABSTRACT

A method of producing an image comprising processing an imagewise exposed silver halide photosensitive material comprising a support having thereon a silver halide emulsion layer containing a silver halide sensitized with a selenium sensitizer in a black-and-white developer which contains a chelate complex salt of a transition metal. In a preferred embodiment, an electric current is passed through the developer to remove halide ions therefrom and to regenerate (reduce) the metal complex. A protective layer may be provided on the silver halide emulsion layer having a thickness of 0.6 μm or less.

16 Claims, 1 Drawing Sheet

METHOD OF PROCESSING A SILVER HALIDE PHOTOSENSITIVE MATERIAL CONTAINING A SILVER HALIDE SENSITIZED WITH A SELENIUM SENSITIZER USING A BLACK-AND-WHITE DEVELOPER CONTAINING A CHELATE COMPLEX SALT OF A TRANSITION METAL

FIELD OF THE INVENTION

The present invention concerns a method of photographic processing whereby a silver halide photosensitive material (hereinafter referred to as a photosensitive material) is processed.

BACKGROUND OF THE INVENTION

Black-and-white photosensitive materials are processed after exposure in processes such as black-and-white development, fixing and water washing. A black-and-white developer is used for black-and-white development, a fixer is used for fixing and town water or ion exchanged water is used for water washing and a stabilizer is used for a stabilizing process. Each processing bath is generally adjusted to a temperature of 20° to 50° C. and the photosensitive material is processed by immersion in these processing baths.

Of these processes, the developing process is a process wherein a developing agent which is a reducing agent acts on silver halide grains which have been sensitive by exposure to light in a photographic emulsion and the $Ag^+$ is reduced to Ag. The silver image in a black-and-white photograph is formed in this way.

At this time, organic compounds such as 3-pyrazolidones and hydroquinones can be used as developing agents and alkaline aqueous solutions of these compounds are generally used as developers. However, it is known that metal compounds which have reducing properties with respect to silver halide grains which have been exposed to light can be used as developing agents as well as organic compounds of this type. The metal compounds in this case include salts and complexes of transition metals such as those based on vanadium, titanium, iron, and chromium for example (in practice, when listed in terms of their atomic symbols, they include Ti, Zr, Hf; V, Nb, Ta, Cr, Mo, W; Mn, Tc, Re; Fe, Ru, Os; Co, Rh, Ir, Ni, Pb, Pt and the like) [*Nippon Shashin Zasshi,* 20 (2), 62 (1957); ibid 19, 40 (1956); *Nippon Shashin Zasshi,* 29, 31 (1966); ibid 45(1), 33 (1982); *Shashin Kogyo, March,* 67 (1967); *Nippon Kagaku Zasshi, No.*9, 1321 (1980); *PSE,* 19, 283 (1975); JP-B-54-41899; *Chiba University Engineering Department Research Reports,* 14, 1 (1962); ibid 21(40), 169 (1970); ibid, 18, 39 (1967); ibid 21(39), 11 (1970); JP-A-50-51731; U.S. Pat. Nos. 3,942,985 and 3,938,998; British Patent 1,462,972, JP-A-57-78534; PSE, 12(6), 288 (1968); *PSE,* 14(6), 391 (1970) etc.]. (The term "JP-A" as used herein signifies an "unexamined published Japanese patent application", and the term "JP-B" as used herein signifies an "examined Japanese patent publication".)

When compared with the organic developing agents which inevitably react with preservatives in the developer and form compounds which cannot be regenerated, these metal compounds can be regenerated by carrying out reduction electrically after development processing. Further, whereas the organic developing agents are used as alkaline liquids, the metal compounds can be used as acidic or neutral aqueous solutions with the result that the swelling of the gelatin film of the photographic photosensitive material is minimized and satisfactory processing can be achieved even when the gelating film strength of the photosensitive material is low. Moreover, the developing agent readily enters the gelatin film and development is rapid and, since the carry-over of the processing bath to the next bath is also reduced, deterioration of the next bath can also be prevented with these metal compounds. Moreover, the metal compounds have an advantage for example in that they can be used as developing agents at high concentrations, but they have disadvantages because the oxidation/reduction potential of the developer changes as the developing reaction proceeds, the activity level cannot be maintained in a stable manner, the image obtained is sometimes poor when compared to that obtained with an organic developing agent and development is slow.

Methods in which development processing is carried out while electrolytically reducing the compounds comprising metal ions of which the oxidation number is increased which are generated by the development reaction and methods in which large amounts of replenisher are used can be cited for example and methods of dealing with the problems such as those indicated above. The former electrolytic reduction method has disadvantages in respect of equipment and costs in that the electrolysis equipment is large and in that a certain amount of replenisher must be added since it is impossible to prevent accumulation of the halide ions which results in an inhibition of development. Furthermore, the latter methods in which the rate of replenishment is increased not only have a cost disadvantage but should also be avoided from the viewpoint of environmental protection. Furthermore, there are also methods wherein the developer is activated by the inclusion of a metal of the same species as the metal complex or metal ion in the developer (JP-B-54-41899) for example, but it is difficult to control the amount of metal added and the procedure is complicated.

The process for reducing a metal complex as well as removing a halide compound during treatment of the light-sensitive material is disclosed in JP-A-4-250449 and JP-A-4-243253.

Said process, however, is liable to cause disadvantages such that developing fog is liable to be caused, and in some occasion maximum density is still insufficient, and film hardness is deficient. In particular, the drawback is found that a developing process is rather slow comparing with a process using a conventional hydroquinone type developing solution.

Hence, a method where the processing performance can be maintained easily, and moreover raising the photographic speed of the image obtained by processing with the developer, reducing the fog level and, in particular, speeding up development are desirable for developers in which the developing agent is a metal compound.

SUMMARY OF THE INVENTION

An object of the present invention is to provide a process with applying an electric current for maintaining a metal complex in a stable reducing state as well as removing accumulated halogen, thereby achieving stable, high performance in high $D_{max}$ and high gamma, and high speed process.

Another object of the present invention is to provide a method of processing silver halide photosensitive materials where the disadvantages described above are overcome, where the processing capacity of a developer which contains a metal compound which can reduce silver halide which has been exposed to light as a developing agent is maintained, and where images of good photographic performance can be obtained.

A further object of the invention is to provide a method of processing silver halide photosensitive materials using metal compounds which can be regenerated time after time as the developing agent, and with which it is possible to achieve a stable performance with no effluent by maintaining the metal compound in a constant and stable reduced state.

A still further object of the invention is to provide a method of processing silver halide photosensitive materials by means of a combination of the photosensitive material, the processing baths and a means of carrying out a passing of electrical power treatment which is stable with no effluent.

According to the present invention, there is provided a method for producing an image comprising processing an imagewise exposed silver halide photosensitive material comprising a support having thereon a silver halide emulsion layer containing a silver halide sensitized with a selenium sensitizer in a black-and-white developer which contains a chelate complex salt of a transition metal.

According to the second aspect of the present invention, there is provided a method of producing an image comprising processing an imagewise exposed silver halide photosensitive material comprising a support having thereon a silver halide emulsion layer containing a silver halide sensitized with a selenium sensitizer in a black-and-white developer which contains a chelate complex salt of a transition metal and a protective layer on the silver halide emulsion layer wherein the protective layer has thickness of 0.6 μm or less.

Figure 1:
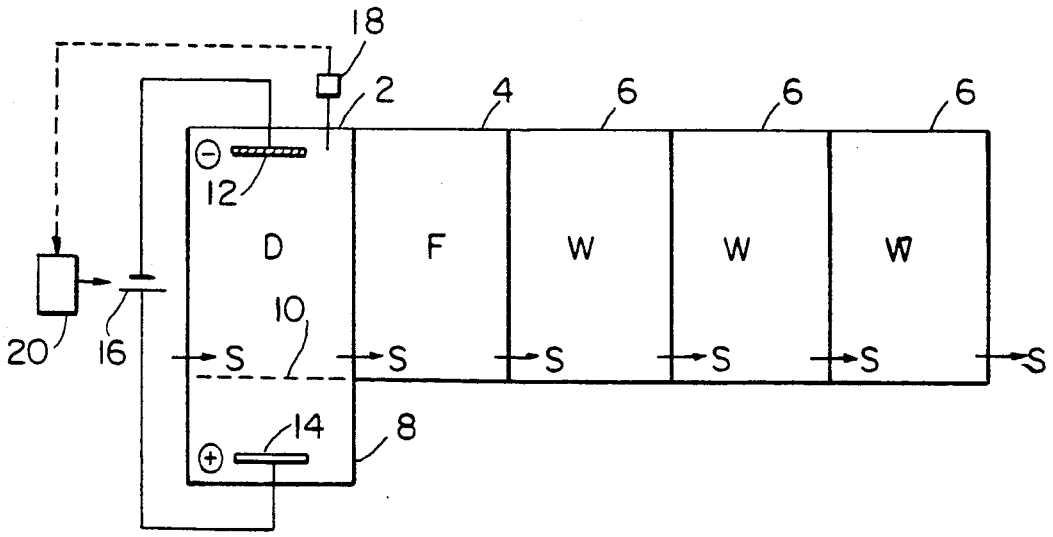
FIG. 1 is a schematic plan view which shows the tank layout of a processing apparatus which is appropriate for use in the present invention.

In the Figures, numerals denote as the following elements: 2: Developing tank, 4: Fixing tank, 6: Water washing tank, 8: Tank for passing of electrical power, 10: Anion exchange membrane, 12: Cathode, 14: Anode, 16: Power source, 18: Electrometer, 20: Control apparatus, S: Photosensitive material, D: Developing tank, F: Fixing tank, and W: Water washing tank

DETAILED DESCRIPTION OF THE INVENTION

The invention is described in greater detail below.

With this system, first of all development becomes slower on changing from an organic developing agent to an inorganic developer but, by speeding up the progress of development by sensitizing the photosensitive material with a selenium sensitizer, it is possible to provide a complete system.

With the present invention, the above-described objects are achieved by means of a method of processing silver halide photosensitive materials in a black-and-white developer which contains a chelate complex salt of a transition metal wherein the photosensitive material contains a silver halide emulsion which has been sensitized with a selenium sensitizer.

More specifically, the present invention provides a method of processing in which selenium sensitized silver halide photosensitive materials are processed in black-and-white developers which contain organic acid metal complex salts.

Conventionally, selenium sensitizers have been added to increase photographic speed in organic developers, but the speeding up of the progress of development in particular in conventional organic developers of the hydroquinone type was not known. On this occasion, unlike findings in the past, it has now been discovered that development is speeded up considerably in an inorganic type developer with a selenium sensitized photosensitive material when compared with a photosensitive material sensitized using some other method of sensitization.

That is to say, with known metal compound containing developers an adequate photographic speed cannot be obtained without prolonging the development time because the development rate is slow. However, with the present invention, these problems are resolved as a present of the use in combination of a selenium sensitized photosensitive material.

In this way the development time is shortened and moreover a good image with satisfactory photographic speed and no fogging can be obtained.

Moreover, the above-described objects of the invention can be achieved by a method in which a silver halide photosensitive material is processed in a black-and-white developer which contains a chelate complex salt of a transition metal wherein the thickness of the protective layer with which the silver halide photosensitive material is constructed is 0.6 μm or less.

Processing in which organic developers are employed is carried out with the developer under conditions of pH 9 to 10.5 and so the protective layer which is established with a view to preventing scratching and pressure sensitization of the emulsion, for example, is readily swelled and a protective layer of thickness 1.0 to 1.2 μm is required to obtain a good image.

On the other hand, when processing in a black-and-white developer of the present invention, the processing can be carried out under conditions of a pH 5 to 7 and so the swelling of the protective layer can be suppressed and good images can be obtained even with a protective layer thickness of 0.6 μm or less. Furthermore, reducing the thickness in this way facilitates permeation of the developer into the photosensitive material, accelerates development and enables rapid processing to be achieved.

Moreover, the above-described objects of the invention can be achieved by means of a method of processing in the above-described black-and-white developers wherein the complex salt is set to the reduced state by passing an electrical current through the developer before development or during development and, moreover, halogen which is produced by development processing is removed.

The present invention enables the redox potential of the developer to be maintained constant and the development activity to be maintained in a stable manner by passing an electrical current through the black-and-white developer which contains a complex salt composed of a transition metal and an organic acid, and the images obtained are also good.

The passing of an electrical current referred to above involves introducing the black-and-white developer which is composed of a metal compound into the cathode chamber of a processing tank in which an anode-anion exchange membrane-cathode have been arranged and it is a means of causing the halogen which dissolves out from the photosensitive material after development to migrate to the anode and thus restoring and maintaining the metal salt in the reduced state at the cathode surface.

The present invention involves carrying out black-and-white development ideally and rationally by combining a metal inorganic developer with the passing of electrical current as described above.

Furthermore, also a small improvement in the metal inorganic development method is achieved when it is applied to an overflow type.

In the present invention, the developer (a developer which contains an organic acid complex salt of a transition metal) is introduced into the tank in such a way that it is in contact with an electrolyte solution via an anion exchange membrane, a cathode is immersed in the developer, an anode is immersed in the electrolyte solution and an electrical current is passed between these electrodes.

Consequently, with a developer which contains a metal compound (for example an Fe(II) compound) which can reduce silver halide which has been exposed to light as the developing agent, a compound composed of metal ions of a higher oxidation number (for example an Fe(III) compound) is formed by the development reaction, but a reaction in which this is reduced occurs at the electrode surface and the developing power is restored. By this means, it is possible to hold the redox potential of the developer constant and to maintain a stable development activity.

Furthermore, halide ions such as $Br^-$, for example, which accumulate in the developer as a result of development processing pass through the anion exchange membrane selectively and are included in the electrolyte solution. The accumulation of unwanted halide ion in the developer is prevented due to this migration of halide ions, and the occurrence of development inhibition is prevented. On the basis of these facts it is possible to obtain satisfactory image density in the development process and it is also possible to prevent any loss of photographic speed and softening of gradation. Furthermore, the replenishment rate in the development process can be reduced, and replenishment can be reduced to the level at which the amount of effluent is practically zero.

Furthermore, the amount of effluent can be reduced by using the rinse bath which has been used in the rinsing process after the fixing process for the electrolyte solution in the system described above.

Hence, in the present invention maintenance control of the processing performance in the developer as described above is simplified and the rate of replenishment can be reduced.

Known selenium compounds can be used as the selenium sensitizers which are used in the present invention. More specifically, in general, an unstable type selenium compound and/or non-unstable type selenium compound can be used by addition to an emulsion at elevated temperature, and preferably at a temperature of at least 40° C., with agitation for a fixed period of time. The use of the compounds disclosed, for example, in JP-B-44-15748, JP-B-43-13489, JP-A-4-25832, JP-A-4-109240 as unstable type selenium compounds is preferred. Actual examples of unstable selenium sensitizers include isoselenocyanates (for example aliphatic isoselenocyanates such as allylisoselenocyanate), selenoureas, selenoketones, selenoamides, selenocarboxylic acids (for example 2-selenopropionic acid, 2-selenobutyric acid), selenoesters, diacyl selenides (for example bis(3-chloro-2,6-dimethoxybenzoyl)selenide), selenophosphates, phosphine selenides and colloidal metallic selenium.

Preferred types of unstable selenium compounds are described above, but the compounds are not limited to these preferred types. The structure of the unstable selenium compound is not important provided that the selenium is unstable and provided that the compound is a sensitizer for photographic emulsions, and it is generally understood that the organic part of the selenium sensitizer molecule has no other role than supporting the selenium and ensuring that it is present in the emulsion in an unstable form. A wide range of unstable selenium compounds can be used effectively in the present invention.

The compounds disclosed in JP-B-46-4553, JP-B-52-34492 and JP-B-52-34491 can be used a non-unstable type selenium compounds which can be used in the present invention. Examples of non-unstable type selenium compounds include selenious acid, potassium selenocyanide, selenazoles, quaternary salts of selenazoles, diaryl selenide, diaryl diselenide, dialkyl selenide, dialkyl diselenide, 2-selenazolidinedione and 2-selenooxazolidinethione, and derivatives thereof.

Of these selenium compounds, those which are represented by the general formulae (I) and (II) indicated below are preferred.

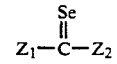

In this formula, $Z_1$ and $Z_2$ may be the same or different and each represents an alkyl group (for example, methyl, ethyl, t-butyl, adamantyl, t-octyl), an alkenyl group (for example, vinyl, propenyl), an aralkyl group (for example, benzyl, phenethyl), an aryl group (for example, phenyl, pentafluorophenyl, 4-chlorophenyl, 3-nitrophenyl, 4-octylsulfamoylphenyl, α-naphthyl), a heterocyclic group (for example, pyridyl, thienyl, furyl, imidazolyl), $—NR_1(R_2)$, $—OR_3$ or $—SR_4$.

$R_1$, $R_2$, $R_3$ and $R_4$ may be the same or different and each represents an alkyl group, an aralkyl group, an aryl group or a heterocyclic group. The same examples as for $Z_1$ can be cited as examples of alkyl groups, aralkyl groups, aryl groups and heterocyclic groups.

Furthermore, $R_1$ and $R_2$ may be hydrogen atoms or acyl groups (for example, acetyl, propanoyl, benzoyl, o heptafluorobutanoyl, difluoroacetyl, 4-nitrobenzoyl, α-naphthoyl or 4-trifluoromethylbenzoyl).

$Z_1$ in general formula (I) preferably represents an alkyl group, an aryl group or $—NR_1(R_2)$, and $Z_2$ preferably represents $—NR_5(R_6)$. $R_1$, $R_2$, $R_5$ and $R_6$ may be the same or different and each represents a hydrogen atom, an alkyl group, an aryl group or an acyl group.

General formula (I) most desirably represents an N,N-dialkylselenourea, an N,N,N'-trialkyl-N'-acylselenourea, a tetra-alkylselenourea, an N,N-dialkylarylselenoamide or an N-alkyl-N-aryl-arylselenoamide.

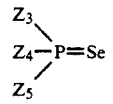

In this formula, $Z_3$, $Z_4$ and $Z_5$ may be the same or different and each represents an aliphatic group, an aromatic group, a heterocyclic group, $—OR_7$, $—NR_8(R_9)$, $—SR_{10}$, $—SeR_{11}$, X or a hydrogen atom.

$R_7$, $R_{10}$ and $R_{11}$ may be the same or different and each represents aliphatic groups, aromatic groups, heterocyclic groups, hydrogen atoms or cations, $R_8$ and $R_9$ may be the same or different and each represents aliphatic groups, aromatic groups, heterocyclic groups or hydrogen atoms, and X represents a halogen atom.

In general formula (II), the aliphatic groups represented by $Z_3$, $Z_4$, $Z_5$, $R_7$, $R_8$, $R_9$, $R_{10}$ and $R_{11}$ are linear chain, branched or cyclic alkyl groups, alkenyl groups, alkynyl groups, aralkyl groups (for example methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl or phenethyl).

In general formula (II) the aromatic groups represented by $Z_3$, $Z_4$, $Z_5$, $R_7$, $R_8$, $R_9$, $R_{10}$ and $R_{11}$ are single ring or condensed ring aryl groups (for example, phenyl, pentafluorophenyl, 4-chlorophenyl, 3-sulfophenyl, α-naphthyl or 4-methylphenyl).

In general formula (II) the heterocyclic groups represented by $Z_3$, $Z_4$, $Z_5$, $R_7$, $R_8$, $R_9$, $R_{10}$ and $R_{11}$ are three to ten membered saturated or unsaturated heterocyclic groups which contain at least one of a nitrogen atom, oxygen atom and sulfur atom as a hetero atom (for example, pyridyl, thienyl, furyl, thiazolyl, imidazolyl or benzimidazolyl).

In general formula (II) the cations represented by $R_7$, $R_{10}$ and $R_{11}$ are alkali metal atoms or ammonium, and the halogen atoms represented by X are, for example, a fluorine atom, a chlorine atom, a bromine atom or an iodine atom.

In general formula (II), $Z_3$, $Z_4$ or $Z_5$ preferably represents an aliphatic group, an aromatic group or —OR;, and $R_7$ preferably represents an aliphatic group or an aromatic group.

General formula (II) most desirably represents a trialkylphosphine selenide, a triarylphosphine selenide, a trialkyl selenophosphate or a triaryl selenophosphate. Specific examples of compounds represented by General formulae (I) and (II) are shown below, but the invention is not to be construed as limited to these examples.

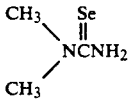

I-1.

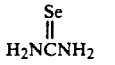

I-2.

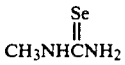

I-3.

-continued

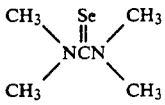

I-4.

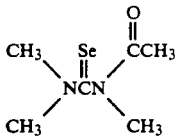

I-5.

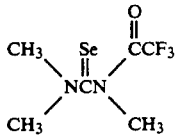

I-6.

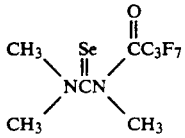

I-7.

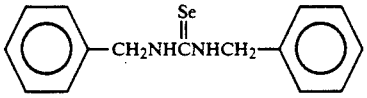

I-8.

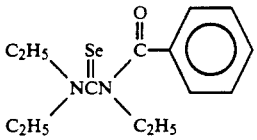

I-9.

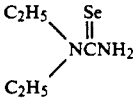

I-10.

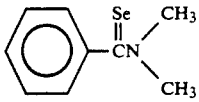

I-11.

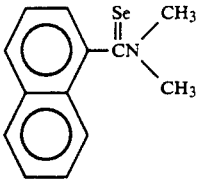

I-12.

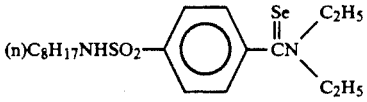

I-13.

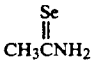

I-14.

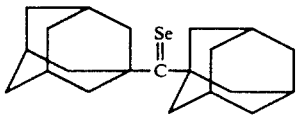

I-15.

-continued

I-16.

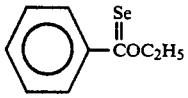

I-17.

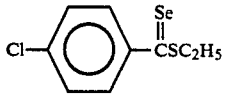

I-18.

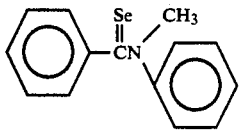

I-19.

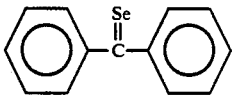

I-20.

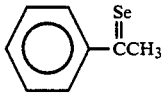

II-1.

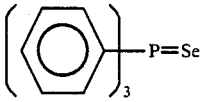

II-2.

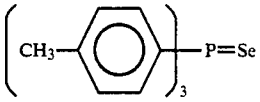

II-3. $(n\text{-}C_4H_9)_3P{=}Se$

II-4.

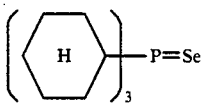

II-5.

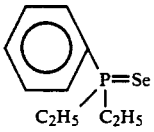

II-6.

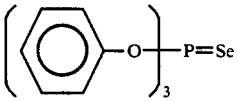

II-7.

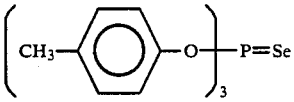

II-8. $(nC_4H_9O)_3P{=}Se$

II-9.

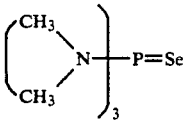

-continued

II-10. $(C_2H_5O)_3P{=}Se$

II-11.

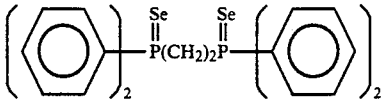

II-12. $(n\text{-}C_8H_{17})_3P{=}Se$

II-13.

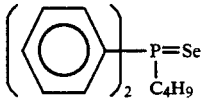

II-14.

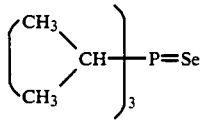

II-15.

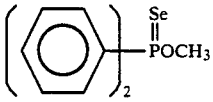

II-16.

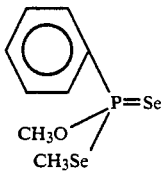

II-17.

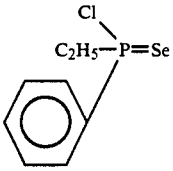

II-18.

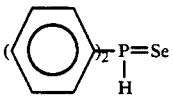

II-19. $(CH_3)_2P{=}Se$, $CH_3S$

The selenium sensitization method is disclosed, for example, in U.S. Pat. Nos. 1,574,944, 1,602,592, 1,623,499, 3,297,446 3,297,447, 3,320,069, 3,408,196, 3,408,197, 3,442,653, 3,420,670 and 3,591,385, French Patents 2,693,038 and 2,093,209, JP-B-52-34491, JP-B-52-34492, JP-B-53-295, JP-B-57-22090, JP-A-59-180536, JP-A-59-185330, JP-A-59-181337, JP-A-59-187338, JP-A-59-192241, JP-A-60-150046, JP-A-60-151637, JP-A-61-246738, JP-A-3-4221, JP-A-3-148648, JP-A-3-111838, JP-A-3-116132, JP-A-3-237450, JP-A-4-25832, JP-A-4-32831 and JP-A-4-109240, Japanese Patent Application No. 2-110558, in British Patents 255,846 and 861,984, and by H. E. Spencer et al. in *Journal of Photographic Science,* Vol. 31, pages 158 to 169 (1983).

These selenium sensitizers are added at the time of chemical sensitization by dissolving them in water or in an individual organic solvent such as methanol or ethanol, or in a mixed solvent, or in the form disclosed in JP-A-4-140738 or JP-A-4-140739. The addition is preferably made before commencement of chemical sensitization. The selenium sensitizer used is not limited to a single type, and two or more of the above-described selenium sensitizers may be used in combination. Unstable selenium compounds and non-unstable selenium compounds may also be used in combination. In the mixture of the selenium compounds, an amount of the non-unstable compound is preferably less than 50 weight% of the unstable selenium compound.

The amount of the selenium sensitizer which can be used in the invention differs according to the activity of the selenium sensitizer which is used, the type and size of the silver halide, the temperature during ripening and the ripening time for example. However, it is preferably at least $1\times10^{-8}$ mol per mol of silver halide. Most desirably the amount used is at least $1\times10^{-7}$ mol and not more than $1\times10^{-5}$ mol per mol of silver halide. The temperature for chemical ripening when a selenium sensitizer is used is preferably at least 45° C. The temperature is most desirably at least 50° C. and not more than 80° C. The pAg and pH values can be varied. For example, the effect of the present invention is obtained over a wide range of pH's, e.g., from 4 to 9.

Selenium sensitization is more effective if it is carried out in the presence of a silver halide solvent.

Suitable silver halide solvents which can be used in the present invention include (a) the organic thioethers disclosed for example in U.S. Pat. Nos. 3,271,157, 3,531,289 and 3,574,628, JP-A-54-1019 and JP-A-54-158917, (b) the thiourea derivatives disclosed, for example, in JP-A-53-82408, JP-A-55-77737 and JP-A-55-2982, (c) the silver halide solvents which have a thiocarbonyl group between an oxygen or sulfur atom and a nitrogen atom disclosed in JP-A-53-144319, (d) the imidazoles disclosed in JP-A-54-100717, (e) sulfite and (f) thiocyanates.

Thiocyanate and tetramethylthiourea are especially desirable as silver halide solvents. Furthermore, the amount of solvent used differs depending on silver halide the type, and in the case of thiocyanate for example the preferred amount is at least $1\times10^{-4}$ mol, and not more than $1\times10^{-2}$ mol, per mol of silver halide.

A silver halide photographic emulsion of the present invention can be provided with a high photographic speed and a low fog level by the combined use of sulfur sensitization and/or gold sensitization in the chemical sensitization process.

Sulfur sensitization is generally carried out by adding a sulfur sensitizer and agitating the emulsion for a fixed period of time at elevated temperature, and preferably at a temperature of at least 40° C.

Gold sensitization is generally carried out by adding a gold sensitizer and agitating the emulsion for a fixed period of time at elevated temperature, and preferably at a temperature of at least 40° C.

Known sulfur sensitizers can be used for the above-described sulfur sensitization. For example, use can be made of thiosulfate, thioureas, allylisothiocyanate, cystine, p-toluenethiosulfonate, rhodanine and the like. The sulfur sensitizers disclosed, for example in U.S. Pat. Nos. 1,574,944, 2,410,689, 2,278,947, 2,728,668, 3,501,313 and 3,656,955, German Patent 1,422,869, JP-B-56-24937 and JP-A-55-45016 can also be used. The amount of sulfur sensitizer added is an amount which is sufficient to increase the photographic speed of the emulsion effectively. This amount varies over an appropriate range depending on various conditions such as the pH, the temperature and the size of the silver halide grains, for example, but it is preferably at least $1\times10^{-7}$ mol, and not more than $5\times10^{-4}$ mol, per mol of silver halide.

The gold compounds generally used as gold sensitizers, in which the oxidation number of the gold may be 1 or +3, can be used as gold sensitizers for the above-described gold sensitization. Typical examples include chloroaurate, potassium chloroaurate, auric trichloride, potassium auricthiocyanate, potassium iodoaurate, tetracyanoauric acid, ammonium aurothiocyanate and pyridyl trichlorogold.

A halide composition in the silver halide emulsion of the present invention is not specifically limited. However, 60 mol % or more of silver chloride is preferably contained in the silver halide emulsions selected from silver chlorobromide, silver iodochlorobromide or silver iodochlorobromide. Further, preferably not more than 3 mol %, more preferably not more than 0.5 mol % of silver iodide is contained.

A method for preparing silver halide emulsion according to the present invention can be carried out by various well known manners in the field of silver halide photographic material. Examples of the preparation method include those disclosed in "Chimie et Physique Photographique", by P. Glafkides, published by Paul Montel Company (1967); "Photographic Emulsion Chemistry" by G. F. Duffin, published by the Focal Press (1966); and "Making and Coating Photographic Emulsion" by V. L. Zelikman et al., published by the Focal Press (1964).

The emulsion of the present invention is preferably monodispersed emulsion, more preferably the emulsion having not more than 20%, most preferably not more than 15%, of variation coefficient.

An average grain size of silver halide grains in the monodispersed silver halide emulsion is 0.5 μm or less, particularly preferably 0.1 to 0.4 μm.

A reaction process of aqueous silver nitrate solution with aqueous halide solution may be carried out in any of a one-side mixing method, double-jet method or combination of these two methods.

As one example of the double-jet method, a control double-jet method, wherein pAg in a liquid phase where a silver halide is formed, maintains constantly, may be used. Further, a silver halide grain is preferably formed using so-called silver halide solvent such as ammonia, thioether, tetrasubstituted thiourea, etc.

The tetrasubstituted thiourea compound is more preferable and is disclosed in JP-A-53-82408 and JP-A-55-77737. An example of the preferable thiourea is tetramethylthiourea, or 1,3-dimethyl-2-imidazolidimethion.

Since in a grain forming method of the control double-jet method or the method using silver halide solvent, a silver halide emulsion having regular crystal grains and having narrow grain size distribution is easily prepared, such a process is useful for preparing emulsion according to the present invention.

The monodispersed emulsion preferably contains a regular crystal grains such as cubic, octahedral, tetradecahedral, etc., and the emulsion containing a cubic crystal is the most preferable.

The silver halide grains may have a uniform phase throughout the grains or a different phase between the inside and the surface layer thereof.

During the formation of the silver halide emulsion for use in the present invention, a cadmium salt, a sulfite salt, a lead salt, a thallium salt, a rhodium salt of a complex salt thereof, an iridium salt or a complex salt thereof, etc, may be present.

In the present invention, a silver halide emulsion especially for exposing line image reproduction, dot reproduction and scanner, is prepared in the presence an iridium salt or complex salt thereof in an amount of $10^{-8}$ to $10^{-5}$ mol/mol silver. The captioned amount of the iridium salt is preferably added before completion of physical ripening in the producing of the silver halide emulsion, particularly at the time for forming silver halide grains.

The iridium salt used includes a water soluble iridium salt or a rhodium complex salt, such as iridium. trichloride, iridium tetrachloride, potassium hexachloroiridate(III), potassium hexachloroiridate(IV), ammonium hexachloroiridate(III), etc.

The emulsion of the present invention may be chemically sensitized by the known process such as a sulfur sensitization, a reduction sensitization, or gold sensitization, alone or in combination. The gold sensitization is the most preferable.

For the sulfur sensitization, a sulfur compound contained in a gelatin as well as various sulfur compounds such as thiosulfates, thioureas, thiazoles, and rhodanines, can be used. Examples of the sulfur sensitizing agent are disclosed in U.S. Pat. Nos. 1,574,944, 2,278,947, 2,410,689, 2,728,668, 3,501,313, and 3,656,955. Preferable sulfur compounds are thiosulfate, and thiourea compound, having pAg of 8.3 or less, more preferably 7.3 to 8.0 on chemically sensitizing the emulsion. In this connection, a combination use of polyvinyl pyrrolidone and thiosulfate reported by Moisar, "Klein Gelatine Proc. Syme." 2nd, pp. 301 to 309 (1973) provides excellent results.

Of noble metal sensitization, a gold sensitization is a typical method using auric compound, principally auric complex. A complex of the noble metals other than gold, such as platinum, palladium, iridium, may be contained. The Example is disclosed in U.S. Pat. No. 2,448,060 and British Patent 618,061.

According to the present invention, a silver halide emulsion particularly suitably used for contact photographic material comprises 90 mol % or more, preferably 95 mol % or more of silver chloride, and preferably comprises silver chlorobromide or silver chloroiodobromide containing 0 to 10 mol % of silver bromide.

When a content of the silver bromide or silver iodide is increased, the photographic material becomes undesirable since a stability under a safelight in daylight room is deteriorated or $\gamma$ becomes lower.

The silver halide emulsion of the present invention preferably contains a complex of transition metals. Example of the transition metals includes Rh, Rn, Re, Os, Ir, and Cr.

An example of ligand includes nitrosyl and thionitrosyl crosslinking ligand, halide ligand such as fluoride, chloride, bromide and iodide, cyanide ligand, cyanate ligand, thiocyanate ligand, selenocyanate ligand, tellurocyanate ligand, acid ligand and aquo-ligand. When the aquo-ligand is existed, the aquo-ligand is preferably occupied one or two thereof.

Various additives used for the light-sensitive material according to the present invention are not specifically limited, and those described in, for example, the corresponding portions shown below can preferably be used:

| Item | Corresponding portion |
|---|---|
| 1) Nucleation accelerator | Right upper column, line 13 at page 9 to left upper column, line 10 at page 16 of JP-A-179939; compound of formulae (II-m) to (II-p) and compound examples II-1 to II-22. |
| 2) Spectral sensitizing dye capable of co-existing | Left lower column, line 13 to right lower column, line 4 at page 8 of JP-A-2-12236; Right lower column, line 3 at page 16 to left lower column, line 20 at page 17 of JP-A-2-103536; and JP-A-1-112235; JP-A-2-124560; JP-A-3-7928; Japanese Patent Applications 3-189532, and 3-411064. |
| 3) Surface active agent, & anti-static agent | Right upper column, line 7 to right lower column line 7 of JP-A-2-12236, and left lower column, line 13 at page 2 to right lower column, line 18 at page 4 of JP-A-2-18542. |
| 4) Anti-fogging agent, & stabilizer | Right lower column, line 19 at page 17 to right upper column, line 4 at page 18 and right lower column, lines 1 to 5 of JP-A-2-103536. |
| 5) Polymer latex | Left lower column, lines 12 to 20 at page 18 of JP-A-2-103536. |
| 6) Compound having an acid group | Right lower column, line 6 at page 18 to left upper column, line 1 at page 19 of JP-A-2-103536, and right lower column, line 13 at page 8 to left upper column, line 8 at page 11 of JP-A-2-55349. |
| 7) Matting agent, sliding agent, & plasticizer | Left upper column, line 15 to right upper column, line 15 at page 19 of JP-A-2-103536. |
| 8) Hardener | Right upper column, lines 5 to 17 at page 18 of JP-A-2-103536. |
| 9) Dye | Right lower column, lines 1 to 18 at page 17 of JP-A-2-103536, and right upper column, line 1 at page 4 to right upper column, line 5 at page 6 of JP-A-2-39042. |
| 10) Binder | Right lower column, lines 1 to 20 at page 3 of JP-A-2-18542. |
| 11) Black spot prohibitor | U.S. Pat. No. 495625 and JP-A-1-118832. |
| 12) Monomethylene compound | JP-A-2-287532, compound of formula (II) (Particularly, compounds II-1 to II-26) |
| 13) Dihydroxybenzenes | Left upper column at page 11 to left lower column at page 12 of JP-A-3-39948; and EP452772A. |

A layer constitution of the photographic material according to the present invention may either form single layer or divide into 2 or 3 layers.

Further, the protective layer also composes single layer or 2 or 3 layers.

In general, the photographic material forms by coating singly or multiply emulsions in order over the support having a subbing layer thereon, and subsequently coating singly or multiply the protective layer. A thickness of the single or multiple emulsion layers is 1 to 15 μm, preferably 2 to 10 μm and a thickness of the protective layer is 0.6 μm or less in total, preferably 0.1 to 0.5 μm.

If the thickness of the protective layer exceeds over 0.6 μm, a development process takes long thereby unsuccessfully attaining the advantages of the present invention.

On the other hand, if the thickness of the protective layer is decreased to less than 0.1 μm, flaws undesirably occur on the film during development.

The film thickness of the present invention may be obtained by a conventional method. As a typical example for determining the film thickness, the specimen is subjected to a commercial contacting type thickness gauge after standing still at 25° C. under 40% of relative humidity for 3 hours.

The protective layer is principally composed of a hydrophilic binder, such as gelatin, gelatin derivatives, and natural high polymer. A reference of the binder is made by the description of the present specification hereinafter described. In the protective layer, an additive, commonly used, such as matting agent, sliding agent and plasticizer may be contained.

The amount of gold sensitizer added differs depending on various conditions but, as a rule, at least $1\times10^{-7}$ mol, and not more than $5\times10^{-4}$ mol, per mol of silver halide is preferred.

No particular limitation is imposed upon the time and order of addition of the sulfur sensitizers and/or the gold sensitizers etc. which can be used in combination with the silver halide solvent and the selenium sensitizer or the selenium sensitizer during chemical ripening. For example, the above-described compounds can be added at the same time or they may be added at different points in time at the initial stage of chemical ripening (which is preferred) or during the course of chemical ripening. Furthermore, when adding the above-described compounds, they should be added in a form dissolved in water or in an organic solvent which is miscible with water, for example, methanol, ethanol or acetone alone or as a liquid mixture.

In the present invention, the black-and-white developer, which contains the organic acid complex salt of a transition metal, may contain pyrazolones, or it may contain an organic acid of which the theoretical metal ion chelating capacity of the chelate which forms the above-described complex salt is at least 1.1 mol with respect to the metal ions of the transition metal, preferably 1.1 to 3.0 mol, and more preferably 1.1 to 2.0 mol.

In the present invention, a good value for the S/N ratio is obtained by including pyrazolones in the developer which contains the complex salt which is composed of a transition metal and an organic acid, and a developer with which the precipitation of insoluble material or a reduction of the activity level of the developer, for example, do not tend to occur is obtained by using the organic acid in a mol ratio with respect to the transition metal of at least 1.1, and it is possible to obtain good images by processing with this developer.

The addition of pyrazolones, for example, phenidone, to a developer to accelerate development during organic development is known, but there have been problems in that fogging was inevitably produced in the image obtained, for example.

On the other hand, it is known that fogging of the image is suppressed and the shadow density is increased when pyrazolones, such as phenidone for example, are added to an inorganic developer. That is to say, noise is reduced and density is enhanced, which is to say that the S/N ratio is greatly improved.

Moreover, when the organic acid which forms a complex salt in a stable manner with the metal is added to an inorganic developer in an amount more than equimolar, and preferably in an amount exceeding 2 mol, with respect to the metal, the state of the developer is remarkably stable and it is thought that the S/N ratio improving effects of compounds such as pyrazoles are also increased.

Furthermore, the use of not more than 5 mol, and preferably not more than 3 mol, of organic acid with respect to the metal is desirable from the point of view of cost.

In the present invention, compounds which can form chelates are preferred for the organic acid which forms a complex salt in a stable manner with the metal.

Phenidone, Phenidone Z, Dimezone and Dimezone S (these are all, trade marks, Ilford, England) can be used as pyrazolones.

Examples of these pyrazolones commercially available include 1-phenyl-3-pyrazolidone, 1-p-tolyl-3-pyrazolidone, 1-m-tolyl-3-pyrazolidone, 1-phenyl-5-methyl-3-pyrazolidone, 1-p-chlorophenyl-3-pyrazolidone, 1-phenyl-5-phenyl-3-pyrazolidone, 1-p-tolyl-5-phenyl-3-pyrazolidone, 1-acetamidophenyl-3-pyrazolidone, 1-phenyl-2-acetyl-4,4-dimethyl-3-pyrazolidone, 1-phenyl-4,4-dimethyl-3-pyrazolidone, 1-m-aminophenyl-4-methyl-4-propyl-3-pyrazolidone, 1-m-acetamidophenyl-4,4-dimethyl-3-pyrazolidone, 1-o-chlorophenyl-4-methyl-4-ethyl-3-pyrazolidone, 1-p-hydroxyphenyl-4,4-dimethyl-3-pyrazolidone, 1-p-methoxyphenyl-4,4-dimethyl-3-pyrazolidone, 1-p-tolyl-4,4-dimethyl-3-pyrazolidone, 1-p-diphenyl-4,4-dimethyl-3-pyrazolidone, 1-o-tolyl-3-pyrazolidone, 1-o-tolyl-4,4-dimethyl-3-pyrazolidone, 1-(p-β-hydroxyethylphenyl)-4,4-dimethyl-3-pyrazolidone, 1-(7-hydroxy-2-naphthyl)-4-methyl-4-n-propyl-3-pyrazolidone, 1-(p-β-hydroxyethylphenyl)-3-pyrazolidone, 5-phenyl-3-pyrazolidone, and 5-methyl-3-pyrazolidone.

The metal which forms the organic metal complex salt of a transition metal (metal compound) which is used as a developing agent in the present invention is a transition metal such as Ti, V, Cr, Mn, Fe, Co, Ni, Cu and the like, and Ti, V, Cr and Fe are preferred, and they have the capability of existing in several different oxidation states.

Hence, when used as a developing agent, in theory those in a lower oxidation state than the highest oxidation state are used, and their reducing power should be used, but in general Ti is used in the form of $Ti^{3+}$, V is used in the form of $V^{2+}$, Cr is used in the form of $Cr^{2+}$, and Fe is used in the form of $Fe^{2+}$. Of these, the use of $Ti^{3+}$ and $Fe^{2+}$ is most desirable.

Metal compounds of this type are complex salts and, preferably $Ti^{3+}$ or $Fe^{2+}$ are the central metal atom of the complex salts and polycoordinate ligands, are the ligands involved. Specific examples of suitable ligands include aminopolycarboxylic acids such as ethylenediamine tetra-acetic acid (EDTA) and diethylenetriamine penta-acetic acid (DTPA) and salts thereof, aminopolyphosphoric acids such as ethylenediamine-N,N,N',N'-tetramethylenephosphoric acid and 1,3-diaminopropanol-N,N,N',N'-tetramethylenephosphoric acid and salts thereof, carboxylic acids such as nitrilotriacetic acid, oxalic acid and citric acid and salts thereof, and phosphoric acids such as nitrilo-N,N,N-trimethylenephosphoric acid and propylamino-N,N-dimethylenephosphoric acid and salts thereof.

The use of complex salts in which EDTA and DTPA, for example, of these are the ligands is preferred.

Furthermore, these complex salts can be formed in the developer by adding a metal salt and the ligand compound, and these methods are also preferred in the present invention.

Reference can be made to JP-B-54-41899 and the literature cited therein for details of metal compounds of this type.

The amount of such a metal compound in the developer should be in the range 1 to 100 grams/liter, and preferably in the range 5 to 50 grams/liter.

Furthermore, various additives such as pH buffers and anti-foggants can be present in a developer of this type, and such additives have been disclosed, for example, in JP-B-54-41899. Furthermore, the developer is used at a pH of 0.5 to 11, preferably at a pH of 1 to 11, and most desirably at a pH in the range 2.5 to 9.

A chelating agent which can form a complex salt with the metal is preferably included in a developer which is to be used with an electrical current treatment.

Specific examples of water soluble chelating agents are shown below.

The compounds indicated below are acids or salts ($Li^+$, $Na^+$, $K^+$, $NH_4^+$).

(1) Carboxylic Acid Based Chelating Agents

| | |
|---|---|
| CyDTA: | Cyclohexanediamine tetra-acetic acid, trans form |
| DHEG: | Dihydroxyethylglycine |
| DTPA | Diethylenetriamine penta-acetic acid |
| DPTA-OH: | Diaminopropanol tetra-acetic acid |
| EDAPDA: | Ethylenediamine di-acetic acid di-propionic acid |
| EDDA: | Ethylenediamine di-acetic acid |
| EDDHA: | Ethylenediamine di o-hydroxyphenylacetic acid |
| EDDP: | Ethylenediamine dipropionic acid |
| EDTA-OH: | Hydroxyethylethylenediamine tri-acetic acid |
| GEDTA: | Glycol ether diamine tetra-acetic acid |
| HIDA: | Hydroxyethylimino-di-acetic acid |
| IDA: | Imino-di-acetic acid |
| Methyl-EDTA: | Diaminopropane tetra-acetic acid |
| NTA: | Nitrilo-tri-acetic acid |
| NTP: | Nitrilo-tri-propionic acid |
| m-PHDTA: | m-Phenylenediamine tetra-acetic acid |
| TTHA: | Triethylenetetramine hexa-acetic acid |
| m-XDTA: | m-Xylylenediamine tetra-acetic acid |
| EDTA: | Ethylenediamine tetra-acetic acid |

As well as Anisidine Blue; Chromazulol S; Furoxine, Methylthymol blue; Methylxylenol blue; Sarcosine cresol red; Stilbenefluo blue S; N,N-bis(2-hydroxyethyl)glycine (2) Phosphonic Acid and Phosphoric Acid Based Chelating Agents Ethylenediamine tetrakis methylenephosphonic acid
Nitrilo-trimethylenephosphonic acid
1-Hydroxyethylidene-1,1-diphosphonic acid
1,1-Diphosphonoethane-2-carboxylic acid
2-Phosphonobutane-1,2,4-tricarboxylic acid
1-Hydroxyethylidine-1,1-diphosphonic acid
1-Hydroxy 1-phosphonopropane-1,2,3-tricarboxylic acid
Catechol-3,5-diphosphonic acid
Sodium pyrophosphate
Sodium tetrapolyphosphate
Sodium hexametaphosphate
α-Alkylphosphonosuccinic acid
1-Hydroxyorgano-1,1-dicarboxylic acid
1-Aminoalkane-1,1-diphosphonic acid
2-Phosphonobutane-1,2-dicarboxylic acid (3) Hydroxy Group Based Chelating Agents Alizarin complexone; Arsenazo-III; Verilon-II; Bispyrazolone; n-Benzoyl-N-phenylhydroxylamine; Bromopyrogallol red; Eliochrome black T; 1-(1-Hydroxy-2-naphthylazo)-6-nitro-2-naphthol-4-sulfonic acid; Calcein; Calsein blue; Calcichrome; Chalcone; Calmagite; Carboxyarsenazo; Chlorophosphonazo-III; Chloranilic acid; Chromotropic acid; Dimethylsulphonazo-III; Dihydroxyazobenzene; Dinitrohydroxyazo-III; Dinitrosulfonazo-III; 2-Furyldioxime; Glycine cresol red; Glyoxal-bis(2-hydroxyanyl); Naphthylazoxine; Naphthylazoxine S; 2-Hydroxy-1-(2-hydroxy-4-sulfo-1-naphthylazo)-3-naphthoic acid; 2-(2-Pyridylazo)chromotropic acid; 1-(2-Pyridylazo)-2-naphthol; 4-(2-pyridylazo)-resorcinol; Phenazo; Pyrocatechol violet; Tairon; Acetylacatone; Fluoryltrifluoroacetone; Hexafluoroacetylacetone; Pivaloyltrifluoroacetone; Trifluoroacetylacetone; N,N-Bis(2-hydroxyethyl)-2-aminoethanesulfonic acid; Triethanolamine (4) Nitrogen and Sulfur Based Chelating Agents Arsemate; Vasocuproin; Vasocuproin sulfonic acid; Vasophenanthroline; Vasophenanthroline sulfonic acid; Bismuthiol-II; 3,3'-Diaminobenzidine; Diantipyrylmethane; Monopyrazolone; Murexide; o-Phenanthroline; Thiooxine.

These chelating agents are desirable to prevent the precipitation of components due to the migration of material from the photographic element and to prevent precipitation resulting from the nature of the water (for example, as a result of the presence of calcium). Moreover, the presence of a metal ion of which oxidation-reduction occurs readily is also more effective to prevent undesired reactions at the electrode. In this case, it is desirable for the chelating agent to be present so that the theoretical metal ion chelating capacity is at least 1.1 mol with respect to the metal ion. The above-described theoretical metal ion chelating capacity is preferably at least 1.5 mol, and most desirably at least 2.0 mol. Thus, the chelating agent is preferably present in excess with respect to the metal ion. This is to prevent precipitation of the metal, to prevent precipitation of calcium in the bath, and to prevent precipitation of substances which have migrated through the anion exchange membrane.

In this case, the use of a chelating agent of a higher molecular weight is preferred since migration of electrolyte solution to the developer side is undesirable. However, a chelating agent which is stable with the metal ion is preferred. The molecular weight of the chelating agent is at least 400, and is preferably 1,000,000 or less. This is because if the molecular weight is higher than 1,000,000 the chelating agent will not dissolve in water, and if it is less than 400 the chelating agent will inevitably pass through the anion exchange membrane.

The stability constant (formation constant: log K) which indicates the stability of the chelating agent with the metal ion is preferably from 2.0 to 40.0. Iron, aluminum, titanium, nickel and cobalt are easily procured and comparatively stable as metals which can be used with chelating agents.

Furthermore, where an electrolyte solution is used for the anode side, an alkaline buffer solution should be added since a slight amount of acid is formed by the passage of the electrical current. Conversely, where it is used for the cathode side, an acidic buffer solution should be used because alkali is produced.

In the present invention, a developer which contains a metal compound which can reduce silver halide which has been exposed to light is used as the developing agent for the development processing of a black-and-white photosensitive material.

At this time, the developer is set in such a way that it is in contact via an anion exchange membrane with an electrolyte solution and a cathode is immersed in the developer and an anode is immersed in the electrolyte solution and the photosensitive material is processed while passing an electrical current between the two electrodes.

The passing of the electrical current in accordance with the present invention involves in practice partitioning off part of the processing tank with an anion exchange membrane, establishing a cathode and an anode via the anion exchange membrane and passing an electrical current through the system. In this method of treatment the unwanted materials or necessary materials are caused to migrate to the prescribed side, passing through the anion exchange membrane, and oxidation and reduction of the liquid components are carried out by means of electrode surface reactions.

The electrode reactions and the numbers of ions of ionic compounds which pass through the anion exchange membrane are proportional to the current which is flowing at the electrode surface in accordance with Faraday's law. A voltage is applied in order to generate a current, but the voltage must be suitable, and generally a voltage of 0.1 to 10 V, and preferably of 0.3 to 5 V, is employed. No current flows if the voltage is below 0.3 V, while unnecessary electrode reactions occur if it is higher than 5 V and the reaction efficiency (current efficiency) with respect to the target material is reduced.

Hence, if a fixed current power source is employed, the passing of electrical current can be controlled appropriately by simply controlling the time, but this method is unsuitable because electrical current is not passed in accordance with the setting where the power source is stopped or the power source is temporarily shut off. Moreover, since such a fixed current power source is expensive, it is desirable that a power supply which is as inexpensive as possible (a battery or an accumulator, for example) should be used.

When a battery or an accumulator is used for the power source, a drop in current occurs as a result of a drop in voltage and it is difficult to control the current. In this case, it is necessary to pass the electrical current in such a way that the product of the time and the current value for a prescribed amount of photosensitive material processed is constant. An integrating ammeter (ammeter) should be used to measure the integrated current value in order to measure the product of current value by time. If a fixed current power source is being used, various commercial ammeters can be used as the ammeter and just the time during which the ammeter is passing current should be integrated. If a fixed current source is not being used then a commercial coulometer or an integrating ammeter can be employed.

For example, the developer can be regenerated appropriately by passing electrical power in such a way that the prescribed number of coulombs for the processing of one film for photographic purposes are passed through the developer.

In an automatic developing apparatus in which there are many tanks which form the subject of the electrical current passing, the treatment can be achieved with a low power source cost if it is not carried out at the same time but with staggered timing. Furthermore, if the anion exchange membrane is used continuously the membrane resistance will increase due to blockage for example. In this case, the applied voltage for providing the fixed current value will increase and this is undesirable. It is necessary to set the membrane resistance below a fixed level in order to prevent this from occurring. Conversely, in such a case the current value will decrease gradually if the applied voltage is constant. In this case again the electrical current passing can be carried out if it is controlled in such a way that the product of the current and time for the prescribed amount of photosensitive material processed is constant.

The electrical current passing treatment as described above should be controlled with the current value in accordance with Faraday's law but, as the case may be, variations in the bulk potential of the developer are detected and the amount of electrical current to be passed may be determined on the basis of this data and the current value. Fuzzy logic may be used as a means of control at this time.

A redox potential measuring device as disclosed in JP-A-60-195544 or JP-A-60-195545 can be used to measure the above-described redox bulk potential of the developer. Furthermore, this potential should be detected and controlled using the method of control disclosed in these specifications.

For example, in the case of a developer, the passage of electrical power is controlled in such a way that the redox potential is within a prescribed range, and the passage of electrical current is interrupted once the redox potential exceeds an upper limit value which has been set and the oxidation of the developer is interrupted. The redox potential of the developer then falls as photosensitive material is processed while the passing of electrical current is interrupted, and the passing of electrical current is started again when the redox potential falls below a lower limit value, the developer is oxidized and the potential is increased.

The passage of an electrical current is preferably carried out during processing in the present invention. By passing an electrical current in this way it is possible to maintain the development activity during processing. Thus, the passage of electrical current should be stopped when processing stops, for example, when a signal which indicates that the processing of the photosensitive material has stopped is received.

The cathode which is used in the present invention may be an electrical conductor or semiconductor which can withstand prolonged use and it may be made of a metal such as stainless steel, aluminum, silver, nickel, copper, zinc, brass or titanium. Stainless steel is especially desirable. The anode should be an insoluble material and an electrical conductor, and in practice it may be composed of carbon (graphite), lead dioxide, platinum, gold, titanium, titanium containing steel or copper and, depending on the particular case, stainless steel may also be used. The form of the two electrodes is preferably plate-like or plate-like with an inset mesh, or plate-like with protrusions, so that they can be fitted easily into the tank. The size of the electrodes is selected appropriately depending on the tank capacity. Moreover, by making the plate-like electrodes very thin and flexible they can be coiled easily and they can be operated easily. They can sometimes be immersed in the liquid and sometimes raised into the air. Furthermore, with a construction of this type, the depth of immersion of the electrode in the liquid can be adjusted and the actual electrode surface area can be controlled.

Any anion exchange membrane can be used in the present invention provided that it is a membrane through which anions permeate selectively, and commercial membranes may be used without modification.

In this case, the anion exchange membrane which is used can be selected in accordance with the valency of the anions of which migration through the anion exchange membrane is preferred. For example, an anion exchange membrane which is selectively permeable only to monovalent anions should be selected with a view to the permeation of the halide ions such as $Br^-$ for example which accumulate in the developer.

In the present invention, a cation exchange membrane, anion exchange membrane or other permeable membrane can be used as a separating membrane for dividing off an electrical current passing chamber for carrying out the passage of electrical current. Of these membranes, an anion exchange membrane is preferred, and any anion exchange membrane can be employed provided that anions permeate selectively, and commercial membranes can be used without modification. Selemion AWV/AMR (made by Asahi Glass), Aciplex A201, A172 (made by Asahi Kasei), Neosepta AM-1-3 (made by Tokuyama Soda), Ionac MA-3148 (made by Ionac Chemicals), Nepton AR103PZL (made by Ionics) and the like can also be used as anion exchange membranes of this type, but the use of commercial membranes with trade names such as Selemion ASV-/ASR (made by Asahi Glass), Neosepta AFN-7 and Neosepta ACS (made by Tokuyama Soda) through which monovalent anions permeate selectively is preferred when the passage of electrical current is carried out with the establishment of a chamber for this purpose in a color developing tank in particular in order to achieve permeation of the halogen ions such as $Br^-$ for example.

Umicron separating membrane which is used in storage batteries (made by Yasa Denchi); the solid electrolyte partitions disclosed on pages 125 to 132 of *Fine Electronics and High Function Materials* by T. Higaki (published by CMC Co., 1983); porous polymer plates (for example, xanthone porous films and woven cloth), porous polyester woven cloth (for example Uerukii made by Toray); and other permeable membranes such as foamed material barriers comprising urethane, polyethylene or polypropylene, for example, can be used as permeable membranes.

Moreover, in the present invention the above-described anion exchange membrane is nominally a membrane through which anions permeate selectively, and in this sense porous ceramic films of a pore size of 0.2 to 20 μm can also be used.

No limitation is imposed upon the electrolyte solution which is used in the present invention. However, use of halides such as NaCl, KCl, LiCl, NaBr, KBr and KI, sulfates such as $Na_2SO_4$ and $K_2CO_3$, nitrates such as $KNO_3$, $NaNO_3$ and $NH_4NO_3$, and carbonates such as $Na_2CO_3$ and $K_2CO_3$ as the electrolyte, for example, is preferred. The concentration of electrolyte in the electrolyte solution is about 0.01 to 30%, and preferably is 0.01 to 20%. Alternatively, a dilute solution of fixer can be used as the electrolyte.

In the description above the electrolyte solution is freshly prepared for use, but a rinse liquid can also be used as the electrolyte solution.

Suitable electrolysis conditions, electrode materials and types of exchange membrane etc. are disclosed in JP-A-3-273237.

In cases where ion exchange water has been used for the rinse liquid, salts which are fixer components which have been carried over by the photosensitive material are admixed with the rinse liquid used. Hence, these rinse liquids can be used without difficulty as electrolyte solutions and it is possible to reduce the amount of effluent in this way.

The above-described rinse liquids which are used may be conventional liquids, but preferably they are rinse liquids to which biocides, fungicides, dye leaching agents and decolorants, for example, have been added.

Furthermore, titanium ion or vanadium ion may be added to the black-and-white developer used in the present invention in the form of $TiCl_3$ or $VCl_3$, and it is known that photographic speed can be improved in this way.

Moreover, silver halide solvents may be added to the black-and-white developer used in the present invention, and examples of suitable silver halide solvents include thiosulfate ion, thioether compounds, mesoionic compounds, thiourea compounds, imidazole compounds, mercaptoimidazole compounds, mercaptotriazole compounds and mercaptotetrazole compounds. These compounds suppress fogging with respect to the $Ti^{3+}$ and $V^{3+}$ compounds and increase shadow density, and they increase the S/N ratio.

Moreover, nitrogen containing compounds may be added to the black-and-white developer used in the present invention which contains a chelating agent—iron complex salt and this is desirable for increasing shadow density. Amines, ammonium salts, quaternary ammonium salts and chain-like and ring-like quaternary ammonium salts may be employed as nitrogen containing compounds. For example, ammonium bromide, triethanolamine, tetramethylamine, alkanolamine and the like can be used.

The photosensitive materials useful in the present invention are various black-and-white photosensitive materials. For example, the photosensitive material may be a black-and-white negative film, a black-and-white printing paper, a black and-white reversal film, a black and-white reversal printing paper, a black-and-white positive film, a photographic material for printing plate making purposes, an X-ray photographic material, a photosensitive material for microscope purposes, a color reversal film or a color reversal printing paper.

The color reversal films and color reversal printing papers referred to above are color photosensitive materials, but a black-and-white developer used in the present invention may be the first developer used in processing the color photosensitive material.

The pH of a black-and-white developer of this type is preferably within the range 2 to 8.5. It is most desirably in the range pH 4 to 7.5.

The fixer which can be used in the fixing process following the development processing of the black-and-white photosensitive material in the present invention is an aqueous solution which contains a fixing agent, and it has a pH of at least 3.8, and preferably of from 4.2 to 7.0.

The fixing agent is sodium thiosulfate or ammonium thiosulfate for example, but the use of ammonium thiosulfate is especially desirable from the viewpoint of the fixing rate involved. The amount of fixing agent used can be varied appropriately, and generally an amount of from about 0.1 to about 3 mol/liter is used.

With the developer system of used in the present invention, the extent of the swelling of the photosensitive material emulsion film is low because the developer pH is a neutral to acidic pH, and as a result of this there is no need to use a fixer which contains an acid hardening agent. Moreover, there is no aluminum in the fixer effluent and this is desirable from an environmental standpoint. Moreover, the fixing rate is also increased.

Although not necessary, water soluble aluminum salts which are used as film hardening agents may be included in the fixer if desired. Examples of these include, for example, aluminum chloride, aluminum sulfate and potassium alum.

Since development processing can be carried out with a developer at an acidic to neutral pH in the present invention, the amount of film hardening agent which is included can be reduced and it is possible to achieve lower pollution levels.

Film hardening agents may be added appropriately in amounts of 0 to 30 g/l, and preferably of 0 to 10 g/l.

The fixer is an aqueous solution which contains a film hardening agent (for example a water soluble aluminum compound), acetic acid and a dicarboxylic acid (for example, tartaric acid, citric acid or salts of these acids) as required in addition to a fixing agent, and it preferably has a pH of 8 or less, and most desirably it has a pH in the range 4.0 to 5.5.

The fixing agent can be sodium thiosulfate or ammonium thiosulfate, for example, and ammonium thiosulfate is especially desirable from the viewpoint of fixing rate. The amount of fixing agent used can be varied appropriately, and in general an amount of from about 0.1 to about 5 mol/liter is used.

Tartaric acid or derivatives thereof, or citric acid or derivatives thereof, may be used individually, or two or more types of these acids may be used in combination, as the above-described dicarboxylic acid. These compounds are effective when present in amounts of 0.005 mol or more per liter of fixer, and they are especially effective in when present in amounts of 0.01 mol/liter to 0.03 mol/liter.

In practice, tartaric acid, potassium tartrate, sodium tartrate, potassium sodium tartrate, ammonium tartrate, ammonium potassium tartrate and the like are used.

Citric acid, sodium citrate, potassium citrate and the like are examples of citric acid and derivatives thereof which can be effectively used in the present invention.

Preservatives (for example, sulfite, bisulfite), pH buffers (for example, acetic acid, boric acid), pH adjusting agents (for example, ammonia, sulfuric acid), image storage improving agents (for example, potassium iodide) and chelating agents which have a hard water softening function and the compound disclosed in JP-A-62-78551 can be present as necessary in the fixer.

The photosensitive materials used in the present invention exhibit excellent performance in rapid development processing with an automatic processor in which the processing time is 15 to 60 seconds.

In the rapid development processing used in the present invention, the development and fixing temperatures and times are 25° C. to 50° C. and less than 25 seconds each, and temperatures of 30° C. to 40° C. and times of 4 to 15 seconds are preferred.

Tartaric acid, citric acid, gluconic acid or derivatives of these acids can be used individually, or two or more types may be used in combination, in the fixer. These compounds are effective when added in amounts of 0.005 mol or more per liter of fixer, and they are especially effective when present in amounts of from 0.01 to 0.03 mol per liter.

A rinse process is carried out after the fixing process in the processing of black-and-white photosensitive materials.

The rinse liquid has the function of removing residual processing chemicals from the previous processes, and it is used in more or less the same way as a water washing bath or washing water.

In this rinse process the rate of replenishment can be set to 3 liters or less per square meter of photosensitive material, and in this case the use of a biocidal procedure with the rinse liquid is desirable.

The ultraviolet irradiation method disclosed in JP-A-60-263939, the method wherein a magnetic field is used as disclosed in JP-A-60-263940, the method in which the water is purified using an ion exchange resin as disclosed in JP-A-61-131632, the method in which ozone is bubbled into the rinse bath, and the methods in which biocides are used as disclosed in JP-A-62-115154, JP-A-62-153952, JP-A-62-220951, JP-A-62-209532 and JP-A-1-91533 can be used as appropriate biocidal procedures.

Moreover, the biocides, fungicides, surfactants and the like disclosed, for example, by L. F. West in "Water Quality Criteria", *Photo. Sci. & Eng.*, Vol. 9, No. 6 (1965), M. W. Beach in "Microbiological Growths in Motion Picture Processing", *SMPTE Journal*, Vol. 85 (1976), R. O. Deegan in "Photo-processing Wash Water Biocides", *J. Imaging Tech.*, 10, No. 6 (1984), and in JP-A-57-8542, JP-A-57-58143, JP-A-58-105145, JP-A-57-132146, JP-A-58-18631, JP-A-57-97530 and JP-A-57-157244 can be used in combination.

Moreover, the isothiazoline based compounds disclosed by R. T. Kreiman in *J. Image. Tech.*, 10, (6), page 242 (1984), the isothiazoline based compounds disclosed in *Research Disclosure*, Vol. 205, No. 20526 (May, 1981), the isothiazoline based compounds disclosed in *Research Disclosure*, Vol. 228, No. 22845 (April, 1983), and the compounds disclosed in JP-A-62-209532, for example, can be used in combination as microbiocides.

Compounds such as those disclosed in Horiguchi, *The Chemistry of Biocides and Fungicides*, Sankyo Shuppan (1982), and in *Biocide and Fungicide Technology Handbook*, published by the Japanese Biocide and Fungicide Association and Hakuhodo (1986) may also be employed.

Stabilizers can also be used instead in the processing of black-and-white photosensitive materials, and reference can be made to the disclosures of JP-A-1-93737, JP-A-1-250947, JP-A-2-103035, JP-A-2-2-103037, JP-A-2-71260 and JP-A-61-267559 in connection with the details of the processing of black-and-white photosensitive materials.

Furthermore, the details of the black-and-white or color photosensitive materials suitable for the present invention are disclosed in JP-A-1-259359 and in the above-described patent literature, for example.

An actual embodiment of the invention is described below with reference to the attached drawings.

FIG. 1 is a schematic plan view of a black-and-white developing apparatus. The black-and-white processing apparatus has developing tank 2, fixing tank and water washing tanks 6 arranged sequentially. Developing tank 2 is filled with developer, fixing tank 4 is filled with fixer and water washing tanks 6 are filled with washing water. After exposure, the photosensitive material (black-and-white) S is processed by sequential immersion in these processing liquids and completely water washed photosensitive material S is dried in a drying area which is not shown in the drawing.

The developer is introduced into developing tank 2, and electrical current passing tank 8 is established adjacent developing tank 2 and partitioned by means of anion exchange membrane 10 which is established between developing tank 2 and electrical current passing tank 8. An electrolyte solution is introduced into electrical current passing tank 8. As a result, the electrolyte solution and the developer are in contact via anion exchange membrane 10. Furthermore, cathode 12 is positioned in contact with the developer and anode 14 is positioned in contact with the electrolyte, and an electrical current is passed between the two electrodes 12 and 14 using power source 16. Furthermore, electrometer 18 is placed in developer tank 2 so that the redox potential of the developer can be measured. Electrometer 18 is connected to control apparatus 20, power source 16 is controlled in accordance with the redox potential of the developer measured by electrometer 18 and so the potential and the amount of current supplied can be controlled.

The time at which the electrical current is passed through the developer may be before development processing, during development processing or after development processing. The electrical current passing treatment is preferably carried out before development processing and the performance of the developer is restored. In practice, the performance of the developer is then in its best condition when the development process is started. Deterioration of the developer is due mainly to the change in the valency of the chelated metal ion, which is the developing agent, to a higher valency as the development processing progresses, but by immersing cathode 12 in the developer and passing electrical current therethrough, electrons are donated to the chelated metal ions of higher ionic valency from the cathode 14 and the metal ions are reduced and lower valency ions are regenerated. Hence, an electrical current passing treatment during development processing is desirable from the standpoint of improving developing efficiency. Furthermore, the chelated metal ions are also oxidized by oxygen in the air and the development performance is reduced as a result of this as well. Thus, by carrying out an electrical current passing treatment before development processing, chelated metal ions with low ionic valency are regenerated in large amounts in the developer and the development efficiency is restored. This is desirable.

Figure 2:
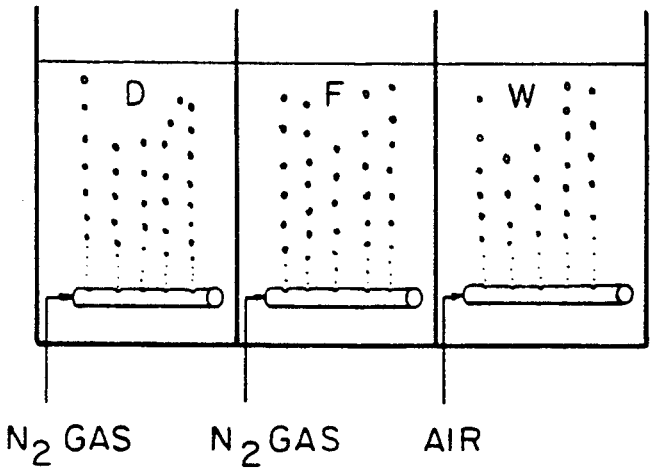
FIG. 2 is a cross sectional view of a modified form of the processing apparatus which is appropriate for use in the present invention.

A cross sectional view of a modified example of a processing apparatus useful in the present invention is shown in FIG. 2. The processing apparatus is provided with developing tank D, fixing tank F and water washing tank W, and $N_2$ gas is introduced into developing tank D and fixing tank F and air is introduced into water washing tank W. These gases bubble up through the liquid and agitate each liquid. The photosensitive material is transported and processed in the same manner as in the apparatus shown in FIG. 1.

The present invention provides a method of processing photosensitive materials with which the maintenance and control of the photographic performance of the developer etc. is simple, with which the replenishment rate of the processing liquids can be reduced, and which provides images which have good photographic performance.

Moreover, the present invention provides a processing system in which metal compounds which can be regenerated repeatedly by the passing of an electrical current through the developer can be used as developing agents, and with which stable performance without effluent can be obtained by maintaining the metal compounds in a constant, stable reduced state.

Moreover, the present invention enables rapid processing to be achieved.

The present invention is hereinafter described in greater detail with reference to the following examples, but the present invention is not to be construed as being limited to these examples. Unless otherwise indicated herein, all parts, percent, ratios and the like are by weight.

EXAMPLE 1

Photosensitive Material

Preparation of Emulsion for Sample 1

| | |
|---|---|
| Solution 1 | |
| Water | 1.0 liter |
| Gelatin | 20 grams |
| Sodium chloride | 20 grams |
| 1,3-Dimethylimidazolidine-2-thione | 20 mg |
| Sodium benzenethiosulfonate | 6 mg |
| Solution 2 | |
| Water | 400 ml |
| Silver nitrate | 100 grams |
| Solution 3 | |
| Water | 400 ml |
| Sodium chloride | 30.5 grams |
| Potassium bromide | 14.0 grams |
| Hexachloroiridium(III) acid, potassium salt (0.001% aqueous solution) | 15 ml |
| Hexabromoiridium(III) acid, ammonium salt (0.001% aqueous solution) | 1.5 ml |

Solutions 2 and 3 were added simultaneously over a period of 10 minutes with agitation to Solution 1 which was maintained at 38° C., pH 4.5, and 0.16 μm grains were formed. Solutions 4 and 5 as shown below were then added over a period of 10 minutes. Moreover, 0.15 gram of potassium iodide was added to complete grain formation.

| | |
|---|---|
| Solution 4 | |
| Water | 400 ml |
| Silver nitrate | 100 grams |
| Solution 5 | |
| Water | 400 ml |
| Sodium chloride | 30.5 grams |
| Potassium bromide | 14.0 grams |
| $K_4Fe(CN)_6$ | 400 mg |

Subsequently, the emulsion was washed with water using the normal flocculation method and then 30 grams of gelatin were added.

This emulsion was divided into two equal parts, the pH was adjusted to 5.5 and the pAg was adjusted to 7.5, 3.7 mg of sodium thiosulfate and 6.2 mg of chloroauric acid were added and chemical sensitization was carried out at 65° C. to obtain optimum photographic speed.

Preparation of Emulsion for Sample 6

The emulsion for Sample 6 was prepared by adjusting the pH to 5.3 and adjusting the pAg to 7.5, adding 1.0 mg of sodium thiosulfate, 2.6 mg of N,N-dimethylselenourea and 4 mg of sodium benzenethiosulfonate, adding 6.2 mg of chloroauric acid and carrying out chemical sensitization at 55° C. to obtain optimum photographic speed.

Preparation of Coated Samples

An ortho sensitizing dye (VII-1) was added in an amount of $5\times10^{-4}$ mol/mol.Ag to the above described emulsions and ortho sensitization was achieved. Moreover, 1-phenyl-5-mercaptotetrazole was added as antifoggants in amounts of 2.5 g and 50 mg per mol of Ag respectively, poly(ethyl acrylate) latex was added as a plasticizer in an amount of 25% as a ratio with the gelatin binder, and 2-bis(vinylsulfonylacetamido)ethane was added as a film hardening agent, and the mixture was coated onto a polyester support so as to provide 3.0 g/m$^2$ of Ag and 1.0 g/m$^2$ of gelatin. A protective layer was coated on the top at the same time.

At this time, a layer to which matting agent (poly(methyl methacrylate), average particle size 3.4 μm) was added in an amount of 0.10 g/m$^2$ so that the amount of gelatin coated was 1.0 g/m$^2$, and to which the fluorine based surfactant of general formula (VII-2) below and sodium p-dodecylbenzenesulfonate were present as coating promotors was coated at the same time as the emulsion layer as a non-photosensitive upper layer.

(VII-1)

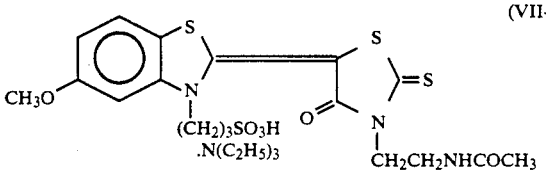

(VII-2)

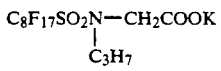

Moreover, the supports for the samples used in this example had a backing layer and a backing protective layer of the composition shown below.

| Backing Protective Layer | |
|---|---|
| Gelatin | 2.0 g/m$^2$ |
| Sodium dodecylbenzenesulfonate | 80 mg/m$^2$ |
| Dye (VII-3) | 70 mg/m$^2$ |
| Dye (VII-5) | 90 mg/m$^2$ |
| 1,3-Divinylsulfonyl-2-propanol | 60 mg/m$^2$ |

(VII-3)

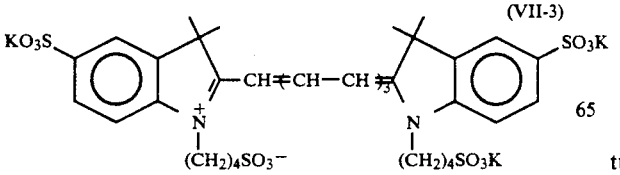

-continued (VII-4)

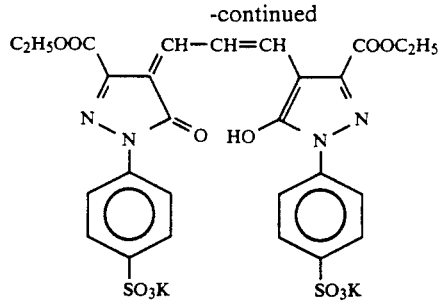

(VII-5)

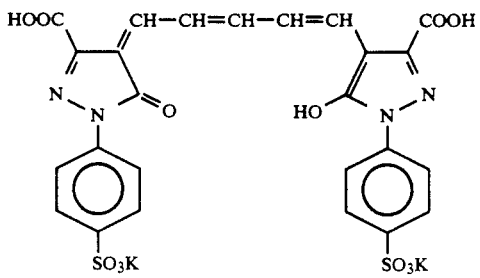

| Backing Layer | |
|---|---|
| Gelatin | 0.5 g/m$^2$ |
| Poly(methyl methacrylate) (average particle size 4.7 μm) | 30 mg/m$^2$ |
| Sodium dodecylbenzenesulfonate | 20 mg/m$^2$ |
| Fluorine based surfactant (VII-2) | 2 mg/m$^2$ |
| Silicone oil | 100 mg/m$^2$ |

Processing Solutions

Formulation 1 shown below was used for the developer.

Fixer GR-Fl for plate making purposes made by the Fuji Photo Film Co., Ltd. was used as the fixing agent.

| | Development | Fix | Water Wash |
|---|---|---|---|
| At 38° C.: | See Table 1 | 20 seconds | 20 seconds |

Processing Apparatus

The apparatus shown in FIG. 2.

| Formulation 1 | |
|---|---|
| Water | 800 ml |
| Ammonia (28% aq. soln.) | 100 ml |
| *EDTA | 60 grams |
| Citric acid (anhydrous) | 38.4 grams |
| KBr | 1 gram |
| $FeSO_4.7H_2O$ | 55.6 grams |
| pH Adjusted to | 6.5–7.0 |
| Water to make up to | 1 liter |

(EDTA: Ferrous sulfate = 2:1 (mol ratio))
*EDTA(4H)
POTITE 4H (EDTA - Free acid) (made by Wako Junyaku)

COMPARATIVE EXAMPLE 1

Formulation A

Prepared According to the description of the literature (Y. Shirai: *Nippon Shasahin Zasshi*, 45(1), 33 (1982))

| Solution A | |
|---|---|
| Water | 100 ml |
| $FeSO_4.7H_2O$ (0.2M) | 27.8 grams |
| Solution B | |
| Water | 250 ml |
| NaOH | 8.15 grams |
| $EDTA.2Na.2H_2O$ (0.067M) | 12.5 grams |
| Citric acid (anhydrous) (0.067M) | 6.4 grams |
| KBr | 0.5 grams |
| Water added to to make up to liquid A + liquid B | 500 ml |
| pH | 7.6 |

[Organic acid: Fe = 0.2:0.13 (mol ratio)]

COMPARATIVE EXAMPLE 2

Formulation B

Prepared according to the description of the literature (A. Sasai *Chiba University Engineering Department Research Reports,* 14(25), 53 (1962))

| | |
|---|---|
| Water | 850 ml |
| Aqueous ammonia | 56 ml |
| $EDTA.2Na.2H_2O$ (0.2M) | 74.5 grams |
| $FeSO_4$ $(NH_4)_2SO_4 6H_2O$ (0.2M) | 78.5 grams |
| KBr | 2.5 grams |
| Water to make up to | 1000 ml |
| pH | 9.5 |

(Organic acid: Fe = 1:1 (mol ratio))

After processing using three types of formulations described above and then allowing such to stand in air for 3 days, electrical current was passed through the developers so that they could be reused, whereupon no precipitation was observed in Formulation 1 of the present invention and Formulation I provided the same level of performance even when it was reused several times with the repeated passage of electrical current. However, precipitation occurred with Formulation A of Comparative Example 1 and Formulation B of Comparative Example 2, and even on passing electrical current, the original level of performance was not restored.

With Formulation 1 used in the present invention, similar photographic performance to that of the original liquid was obtained even on treatment with the addition of 1 g/l of KBr following the passage of an electrical current (2V, 1.2A, 10 minutes) after cutting off the supply of nitrogen and allowing such to stand in air for 2 days, and no precipitation occurred.

The black-and-white development times and the resulting photographic performance at this time and, for comparison, the black-and-white development time and the resulting photographic performance in the case of a conventional type hydroquinone developer (Developer Solution LD835 for Fuji Rapid Access Processing) are shown below.

TABLE 1

| Photosensitive Material | Development Time | | Photographic Performance | | |
|---|---|---|---|---|---|
| | LD835 (38° C.) | Formulation-1 (38° C.) | Photographic Speed | Gradation | Fog |
| Sample 1 (Without Se) | 14 Seconds | — | 100 | 6.0 | 0.04 |
| | — | 40 Seconds | 101 | 8.3 | 0.02 |
| | — | 30 Seconds | 73 | 6.2 | 0.02 |
| | — | 20 Seconds | 49 | 4.3 | 0.02 |
| Sample 6 (with Se) | 14 Seconds | — | 141 | 5.9 | 0.04 |
| | — | 40 Seconds | 202 | 8.1 | 0.02 |
| | — | 30 Seconds | 177 | 7.8 | 0.02 |
| | — | 20 Seconds | 129 | 6.4 | 0.02 |
| Sample 6 (with Se) | — | 14 Seconds | 93 | 6.1 | 0.02 |

Gradation is the most important aspect of photographic performance with this photosensitive material, and a gradation of at least 5.5 is required.

With Sample 1 (without Se), processing can be speeded up to a minimum of only 30 seconds, but with Sample 6 (with Se), more or less the same speed and gradation as with LD835, were obtained in 14 seconds. Moreover the fog level was also reduced.

EXAMPLE 2

When 0.5 g/liter of 1-phenyl-3-pyrazolidone (Reagent Pyrazone made by the Fuji Photo Film Co., Ltd.) was added to Formulation 1 of Example 1 there was no increase in the fog level at 38° C., 14 seconds with Sample 6 (with Se) even though the photographic speed was increased to 123 and the gradation was increased to 6.5.

On comparing the increased fog density when development was pushed in this liquid with LD835 it was seen that the fog was low and that the $D_{max}$ density was also increased.

EXAMPLE 3

The development part of the apparatus used in Example 1 was equipped so that an electrical current could be passed in the manner indicated in FIG. 1 and 1000 half-plate size sheets were processed continuously using the material of Sample 6 (with Se). At this time, the change in photographic performance was small and a constant scanner print image was obtained when the quantity of electrical current passed per sheet of half-plate size was that provided in 40 seconds at 2V, 1.5A (current density 0.4 $A/dm^2$). Moreover, in terms of replenisher, the developer of Formulation 1 required reduced replenishment and so there was no overflow of developer. That is to say, the amount of effluent was reduced to zero by using Formulation 1 and passing an electrical current. Moreover, when the material of Sample 1 (without Se) was used, performance as good as that shown in Example 1 was not obtained. On the other hand, with the photosensitive material of Sample 6 (with Se), a high sensitivity as good as or better than that in Example 1 and a high gradation were obtained.

EXAMPLE 4

On adding $VCl_3$ and $TiCl_3$ in amounts of 10 g/liter of each to Formulation 1 in Example 1 and processing in the same manner as in Example 1, development was more rapid than with Formulation 1 and a similar performance was obtained in each case at 38° C., 45 seconds.

EXAMPLE 5

Similar performance was obtained when Formulation 2 shown below was used in place of Formulation 1 of Example 1.

| Formulation 2 | |
|---|---|
| Water | 800 ml |
| EDTA.Fe.$NH_4$.2$H_2O$ (Kiresuto FNO, made by the Chubu Kiresuto Co.) | 79.6 grams |
| EDTA.2Na | 2 grams |
| Citric acid (anhydrous) | 12.8 grams |
| Aqueous ammonia (28%) | 30 ml |
| KBr | 1 gram |
| pH Adjusted to | 6.5–7.0 |
| Water to make up to | 1 liter |

EXAMPLE 6

An adequate $D_{max}$ was obtained at 38° C. in 20 seconds when Formulation 4 shown below was used in place of the developer used in Example 1, but $D_{min}$ increased. When 60 g/liter of anhydrous hypo was added to this formulation $D_{min}$ was reduced and, conversely, $D_{max}$ increased and the S/N ratio was improved. As shown in Table 2, the effect of adding the hypo was greater with the Se sensitized photosensitive material.

TABLE 2

| Developer Formulation<br>Development Temp. and Development Time | $D_{min}$ | $D_{max}$ | $D_{max}/D_{min}$ (S/N Ratio) |
|---|---|---|---|
| Formulation 4 38° C. | | | |
| Sample 1 20 seconds (Comparative Example) | 0.03 | 4.51 | 150 |
| Sample 6 20 seconds (Comparative Example) | 0.03 | 5.31 | 177 |
| Formulation 4 + Hypo 38° C. | | | |
| Sample 1 20 seconds (Comparative Example) | 0.03 | 5.30 | 177 |
| Sample 6 20 seconds (This Invention) | 0.02 | 5.49 | 275 |

| Formulation 4 | |
|---|---|
| Water | 600 ml |
| EDTA.2Na.2$H_2O$ | 96.8 grams |
| $CH_3COONa$ | 20 ml |
| KBr | 4 grams |
| $TiCl_3$ (20%) | 150 ml |
| Adjusted to pH 4.0 by adding NaOH | |
| Water to make up to | 1 liter |

EXAMPLE 7

Development was speeded up when 3 g/liter of $C_4H_9N(CH_2CH_2OH)_2$ was added to the developer of Example 5, and the same performance was obtained at 38° C. 12 seconds. That is to say, development was speeded up by 15%.

While the invention has been described in detail and with reference to specific embodiments thereof, it will be apparent to one skilled in the art that various changes and modifications can be made therein without departing from the spirit and scope thereof.

What is claimed is:

1. A method of producing an image comprising processing an imagewise exposed silver halide photosensitive material comprising a support having thereon a silver halide emulsion layer containing a silver halide sensitized with a selenium sensitizer in a black-and-white developer which contains a chelate complex salt of a transition metal.

2. A method of producing an image comprising processing an imagewise exposed silver halide photosensitive material comprising a support having thereon a silver halide emulsion layer containing a silver halide sensitized with a selenium sensitizer in a black-and-white developer which contains a chelate complex salt of a transition metal and a protective layer on the silver halide emulsion layer wherein the protective layer has a thickness of 0.6 μm or less.

3. The method of producing an image according to claim 1, wherein said method additionally includes passing an electrical current through said black-and-white developer before processing said exposed silver halide photosensitive material or during said processing of said exposed silver halide photosensitive material in said black-and-white developer.

4. The method of producing an image according to claim 3, wherein said method additionally includes removing any halogen ions accumulating in said black-and-white developer during said processing.

5. The method of producing an image according to claim 1, wherein said processing is at a pH of 5 to 9.

6. The method of producing an image according to claim 1, wherein said chelate complex salt of a transition metal is a chelate complex salt of an organic acid and said transition metal.

7. The method of producing an image according to claim 1, wherein said selenium sensitizer is an isoselenocyanate, a selenourea, a selenoketone, a selenoamide, a selenocarboxylic acid, a selenoester, a diacyl selenide, a selenophosphate, a phosphine selenide, a colloidal metallic selenium, selenious acid, potassium selenocyanide, a selenazole, a quaternary salt of a selenazole, a diaryl selenide, a diaryl diselenide, a dialkyl selenide, a dialkyl diselenide, a 2-selenazolidinedione or a 2-selenooxazolidinethione.

8. The method of producing an image according to claim 7, wherein said selenium sensitizer is a selenium compound selected from the group consisting of compounds of the formula (I) or (II)

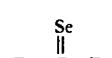

(I)

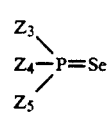

(II)

wherein $Z_1$ and $Z_2$ may be the same or different and each represents an alkyl group, an alkenyl group, an aralkyl group, an aryl group, a heterocyclic group, —$NR_1(R_2)$, —$OR_3$ or —$SR_4$; $R_1$, $R_2$, $R_3$, and $R_4$ may be the same or different and each represents an alkyl group, an aralkyl group, an aryl group or a heterocyclic group; $Z_3$, $Z_4$ and $Z_5$ may be the same or different and each represents an aliphatic group, an aromatic group, a heterocyclic group, —$OR_7$, $NR_8(R_9)$, —$SR_{10}$, —$SeR_{11}$, X or a hydrogen atom; $R_7$, $R_{10}$ and $R_{11}$ may be the same or different and each represents an aliphatic group, an aromatic group, a heterocyclic group, a hydrogen atom or a cation; $R_8$ and $R_9$ may be the same or different and each represents an aliphatic group, an aromatic group, a heterocyclic group or a hydrogen atom; and X represents a halogen atom.

9. The method of producing an image according to claim 1, wherein said transition metal is titanium, vanadium, chromium, manganese, iron, cobalt, nickel or copper.

10. The method of producing an image according to claim 2, wherein said method additionally includes passing an electrical current through said black-and-white developer before processing said exposed silver halide photosensitive material or during said processing of said exposed silver halide photosensitive material in said black-and-white developer.

11. The method of producing an image according to claim 10, wherein said method additionally includes removing any halogen ions accumulating in said black-and-white developer during said processing.

12. The method of producing an image according to claim 2, wherein said processing is at a pH of 5 to 9.

13. The method of producing an image according to claim 2, wherein said chelate complex salt of a transition metal is a chelate complex salt of an organic acid and said transition metal.

14. The method of producing an image according to claim 2, wherein said selenium sensitizer is an isoselenocyanate, a selenourea, a selenoketone, a selenoamide, a selenocarboxylic acid, a selenoester, a diacyl selenide, a selenophosphate, a phosphine selenide, a colloidal metallic selenium, selenious acid, potassium selenocyanide, a selenazole, a quaternary salt of a selenazole, a diaryl selenide, a diaryl diselenide, a dialkyl selenide, a dialkyl diselenide, a 2-selenazolidinedione or a 2-selenooxazolidinethione.

15. The method of producing an image according to claim 14, wherein said selenium sensitizer is a selenium compound selected from the group consisting of compounds of the formula (I) or (II)

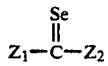

(I)

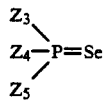

(II)

wherein $Z_1$ and $Z_2$ may be the same or different and each represents an alkyl group, an alkenyl group, an aralkyl group, an aryl group, a heterocyclic group, $—NR_1(R_2)$, $—OR_3$ or $—SR_4$; $R_1$, $R_2$, $R_3$, and $R_4$ may be the same or different and each represents an alkyl group, an aralkyl group, an aryl group or a heterocyclic group; $Z_3$, $Z_4$ and $Z_5$ may be the same or different and each represents an aliphatic group, an aromatic group, a heterocyclic group, $—OR_7$, $NR_8(R_9)$, $—SR_{10}$, $—SeR_{11}$, X or a hydrogen atom; $R_7$, $R_{10}$ and $R_{11}$ may be the same or different and each represents an aliphatic group, an aromatic group, a heterocyclic group, a hydrogen atom or a cation; $R_8$ and $R_9$ may be the same or different and each represents an aliphatic group, an aromatic group, a heterocyclic group or a hydrogen atom; and X represents a halogen atom.

16. The method of producing an image according to claim 2, wherein said transition metal is titanium, vanadium, chromium, manganese, iron, cobalt, nickel or copper.

* * * * *